United States Patent [19]

Williams et al.

[11] 4,404,782

[45] Sep. 20, 1983

[54] SUSPENDED MODULAR FLOOR ASSEMBLY

[76] Inventors: Virgil R. Williams, 2055 Webb Jin House Rd., Snellville, Ga. 30278; James M. Williams, Jr., 2980 Payton Rd., NE., Atlanta, Ga. 30345

[21] Appl. No.: 180,137

[22] Filed: Aug. 21, 1980

[51] Int. Cl.[3] ..... E04B 5/52; E04B 5/58

[52] U.S. Cl. ..... 52/475; 52/484; 52/585; 52/592; 52/799

[58] Field of Search ..... 52/DIG. 12, 484, 236.3, 52/126, 580, 585, 582, 589, 592, 799, 801, 822, 827, 403, 485, 729, 793, 309.11, 745, 475

[56] References Cited

U.S. PATENT DOCUMENTS

| | | | |
|---|---|---|---|
| 1,867,433 | 7/1932 | Young | 52/483 |
| 2,103,969 | 12/1937 | Davis et al. | 52/485 |
| 2,715,013 | 8/1955 | Slick | 52/126 |
| 2,923,305 | 2/1960 | Cline | 52/585 |
| 4,090,339 | 5/1978 | Anderson | 52/580 |

FOREIGN PATENT DOCUMENTS

| | | | |
|---|---|---|---|
| 667593 | 7/1963 | Canada | 52/403 |

*Primary Examiner*—John E. Murtagh
*Assistant Examiner*—Michael Safavi

[57] ABSTRACT

The suspended modular floor assembly includes a plurality of modules of similar size and shape positioned in abutment with one another at their edges and suspended from an overhead ceiling support truss of an industrial building. Each module includes parallel side beams and parallel end beams joined at their ends to form a rectangular frame, with the beams each including external tongue and groove surfaces to mate with the tongue and groove surfaces of the adjacent modules. A plurality of elongated cross braces extend parallel to one another across the rectangular frame, a corrugated support sheet is mounted on the cross braces, and a flat sheet is supported by the corrugated support sheet. Connector pins fit through and join the tongue and groove edge portions of abutting modules, a gasket seals the modules at their abutting edges and eye bolts extend through the beams of the rectangular frames of the modules and are connectable to suspension cables that support the modules of the floor assembly from the overhead truss of the building.

6 Claims, 4 Drawing Figures

SUSPENDED MODULAR FLOOR ASSEMBLY

BACKGROUND OF THE INVENTION

When maintenance must be performed on the roof support truss of an industrial building, as when the truss must be sandblasted and painted, it is desirable to perform the maintenance without disturbing the industrial operation being performed on the work floor below. For example, in a paper mill and in other industrial processes where a substantial amount of moisture is generated within the building the roof trusses and other overhead structures deteriorate rapidly, and it is necessary to sandblast and paint the roof trusses, etc., but it is also desirable to maintain the manufacturing operation on the work floor below while the maintenance operation is being performed. In order to sandblast and paint the roof trusses while continuing the manufacturing operation below, it is desirable to physically separate the roof trusses from the manufacturing equipment below so that the humid environment of the manufacturing process is isolated from the roof trusses, and so that the sand and paint used on the roof trusses are not allowed to fall into the manufacturing process. Also, it is necessary to provide a stable support for the workmen and their equipment as they work about the truss, etc.

In the past, in order to provide a temporary floor structure that supports the workmen about the roof support truss and which forms a barrier between the overhead truss and work space below, cables have been stretched from one side to the other of an industrial building to form a support lattice and plywood panels have been placed on the cables to form a suspended floor surface immediately beneath the roof truss. Usually, the plywood panels were taped to one another along their abutting edges to hold them in place and to cover the cracks between the panels and vinyl sheets or other air impervious sheet material was laid across the plywood panels so as to form a seal on top of the plywood panels. It is important that the suspended floor be relatively thin so that the cranes and other tall structures used in the manufacturing process below can continue to function without impediment from the temporary suspended floor.

During the sandblasting and painting of a roof truss, a substantial amount of sand and debris accumulates on the suspended floor and the sand together with the workmen and their equipment must be supported sufficiently to avoid injury or spilling of sand, etc. the plywood panels placed in the suspended floor tend to "work" or move with respect to one another during the cleaning and painting process, sometimes failing to properly support the sand and the workers and their equipment, and the plywood panels tend to warp and otherwise deteriorate due to moisture from the manufacturing process carried on below the suspended floor and due to abrasion, impact and other wear and to environmental conditions as they are used in the suspended floor structure and due to handling between cleaning and painting sites. The deterioration of the plywood panels increases the hazard to the workers that work on the suspended floor, but the contractor occasionally uses damaged plywood panels when it is inconvenient to acquire replacement panels. Also, the working of the plywood panels with respect to one another tends to damage the tape and sheet material, creating a hazard for the workmen and perforating the seal between the roof support truss and the work floor below.

SUMMARY OF THE INVENTION

Briefly described, the present invention comprises a suspended modular floor assembly for use in cleaning and painting roof support trusses of industrial buildings and the like, wherein a plurality of modules of similar size and shape are placed in abutment with one another at their edges and are suspended from the roof truss and over the work floor below the roof truss. Each module of the floor assembly includes tongue and groove edges which interfit with the tongue and groove edges of adjacent modules, and connecting pins project downwardly through the mated tongue and groove edges to connect the modules together. The modules are each formed with parallel side beams and parallel end beams of similar design, with each beam being joined at its ends to an adjacent beam and forming a peripheral rectangular frame. A plurality of elongated cross braces extend parallel to one another and are connected at their ends to the side beams. A corrugated support sheet is positioned over the cross braces with the folds of its corrugations extending across the lengths of and engaging the cross braces, and a flat sheet is positioned on the corrugated support sheet and joined at its edges to the rectangular frame. The assembled structure is light weight and strong and its tongue and groove edge structure mates with, seals against and fastens to the tongue and groove structure of the adjacent modules so as to avoid working of the modules with respect to one another. If desired, the modules can be taped together at their abutting edges to further seal the modules, and a layer of impervious sheet material, such as vinyl, polyethelene or mylar can be spread over the formed modular floor assembly to further seal the floor assembly from leakage of sand, paint or other material through the floor assembly. Eye bolts extend through the peripheral frames of at least some of the floor modules, and suspension cables or the like are connected to the eye bolts and to the roof truss to support the modular floor assembly from the roof truss.

Thus, it is an object of this invention to provide a modular floor assembly which can be expediently and safely suspended from the roof truss of an industrial building or the like during sandblasting and painting, etc. the roof truss, that forms a barrier between the roof truss and the work floor and prohibits leakage of sand, paint and other material from about the roof truss to the area below the suspended floor assembly.

Another object of this invention is to provide a module for use in a suspended floor assembly which includes a rectangular peripheral frame with an outwardly projecting tongue and groove structure so that the interfitting of the edge portions of the modules forms a firm connection between the modules and substantially seals the modules together.

Another object of this invention is to provide a strong, relatively thin modular floor structure for suspension from an overhead roof truss or the like which is expedient and safe to assemble, strong and durable, and which can be assembled and disassembled for repeated use substantially without hazard of damage thereto during use and the normal assembly and disassembly procedures.

Other objects, features and advantages of the present invention will become apparent upon reading the following specification when taken in conjunction with the accompanying drawings.

DETAILED DESCRIPTION

Figure 1:
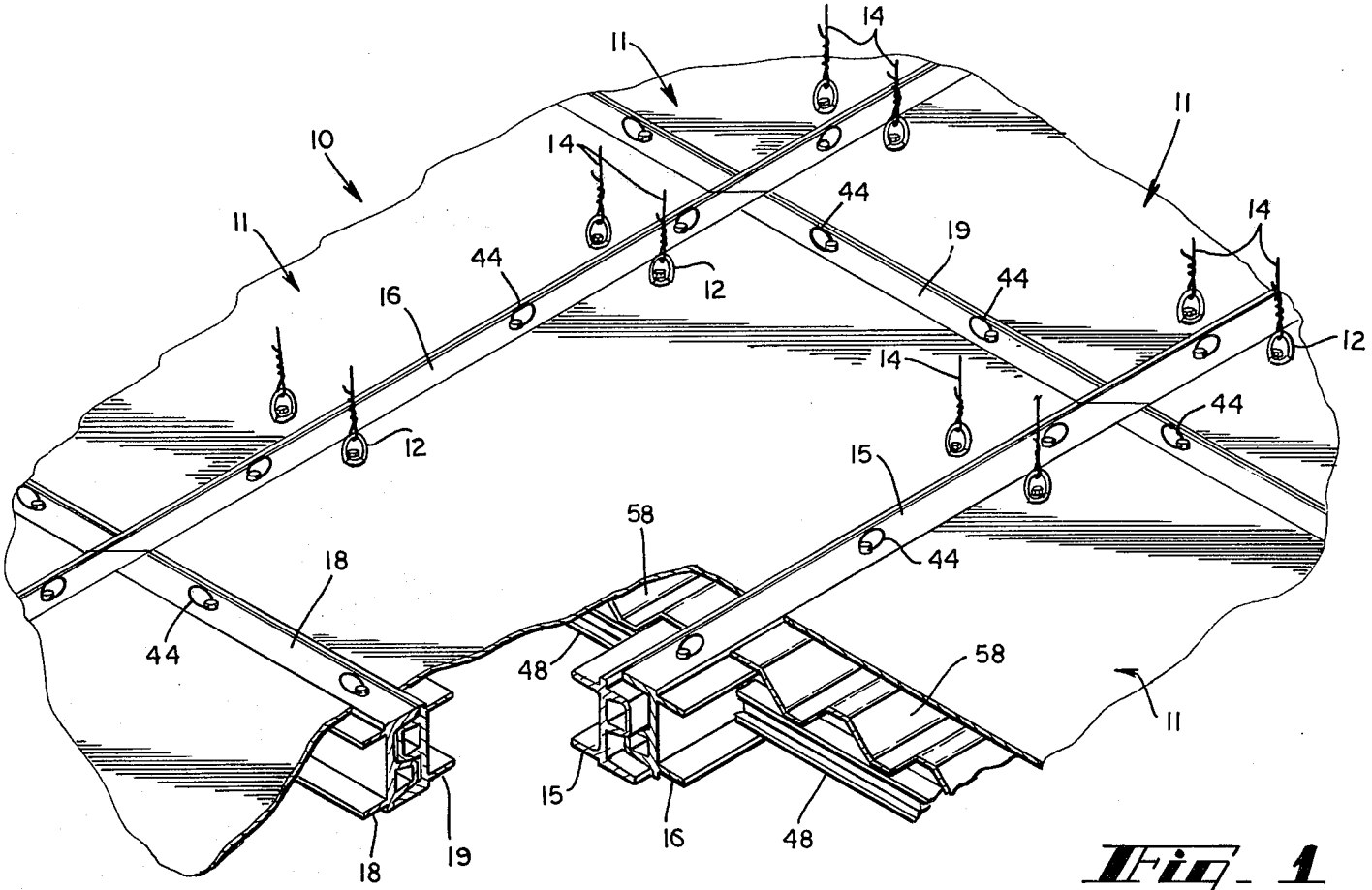
FIG. 1 is a partial perspective illustration, with parts broken away, of a suspended modular floor assembly.

Referring now in more detail to the drawings, in which like numerals indicate like parts throughout the several views, FIG. 1 illustrates a portion of a suspended modular floor assembly 10 wherein a plurality of floor modules 11 are placed with their side edges in abutment with one another, the edges connected together, with eye bolts 12 connected to the modules, and suspension cables 14 connected to the eye bolts and to the overhead trusses (not shown) of the roof structure and suspending the modular floor assembly from the roof structure.

Figure 2:
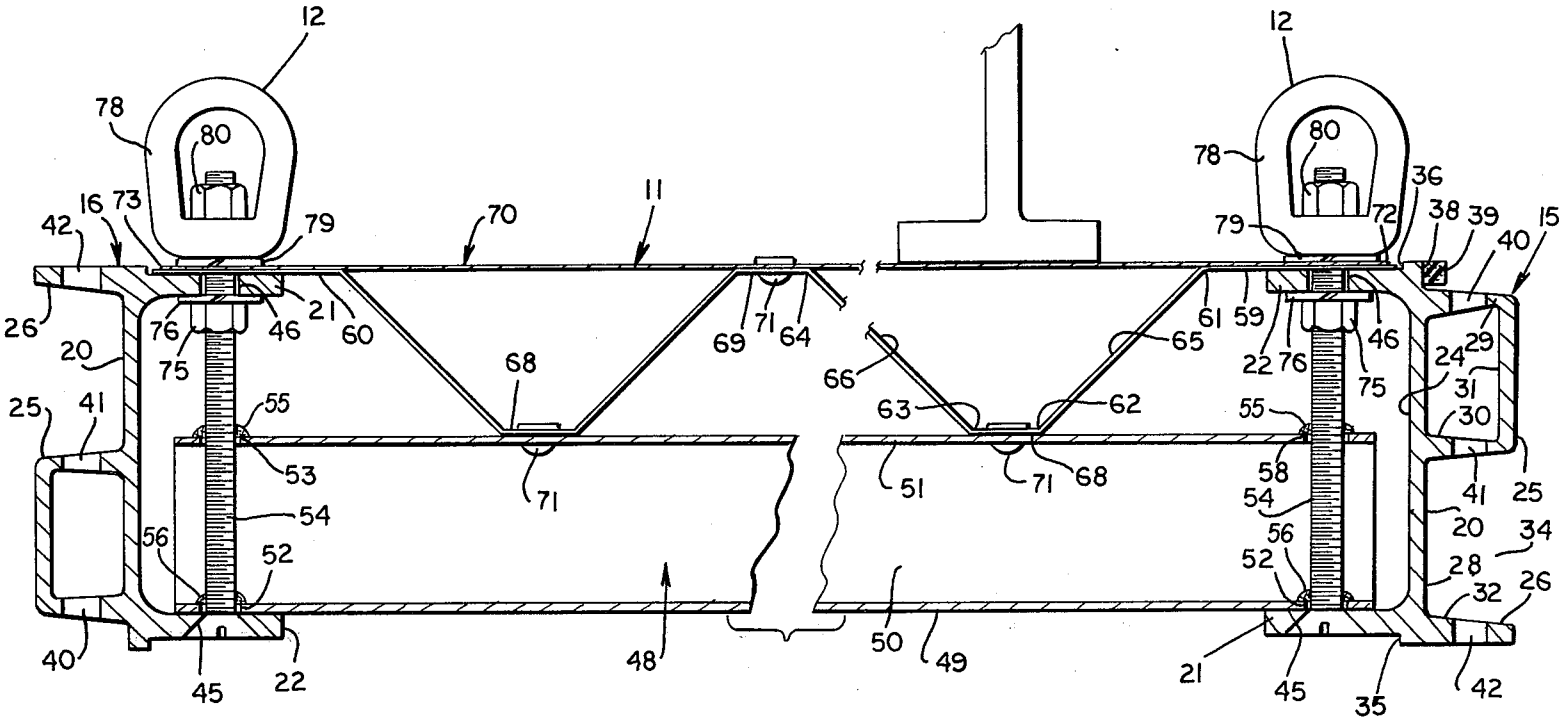
FIG. 2 is an end cross-sectional view, with a portion broken away, of a floor module.

As illustrated in FIGS. 1 and 2, each floor module 11 comprises side beams 15 and 16 and end beams 18 and 19 of identical cross-sectional shape, with the side beams 15 and 16 oriented parallel to each other and end beams 18 and 19 oriented parallel to each other, and the beams being connected at their ends as by welding to form a rectangular frame. As illustrated in the right portion of FIG. 2, each beam 15, 16, 18 and 19 comprises a centrally located web 20 with a pair of parallel, lower and upper spaced apart flanges 21 and 22 extending at a right angle from the inner surface 24 of web 20, and a box formation 25 and a lower flange 26 extending from the outer surface 28 of web 20. Box formation 25 includes upper wall 29, lower wall 30 and outer wall 31. Upper and lower walls 29 and 30 are each connected at one edge to the outer surface 28 of web 20, and outer wall 31 is connected at its edges to the outer portions of upper and lower walls 29 and 30. The external surfaces of upper and lower walls 29 and 30 are tapered inwardly from web 20 toward outer wall 31. The upper surface 32 of lower flange 26 is also tapered at an angle corresponding to the taper of upper wall 29 of box formation 25. The space 34 between lower flange 26 and box formation 25 is of a height and width substantially identical to the height and width of box formation 25 so that the box formation 25 of one side beam or end beam of the rectangular frame can fit into the space 34 of a side beam or end beam of the rectangular frame of another floor module. Thus, a tongue and groove structure is formed by the box formation 25 and space 34 so that the external surfaces of side beams 15 and 16 and end beams 18 and 19 can be nested together in an interfitting relationship.

A ridge 35 is formed on the lower surface of beam 15 so that there is a step between outer lower flange 26 and inner lower flange 21. Also, there is a ridge 36 formed on upper flange 22 over web 20 to form a step above the upper surface of upper flange 22. Ridges 35 and 36 are of equal height and are equally spaced from the plane of the inner surface 24 of web 20.

Figure 3:
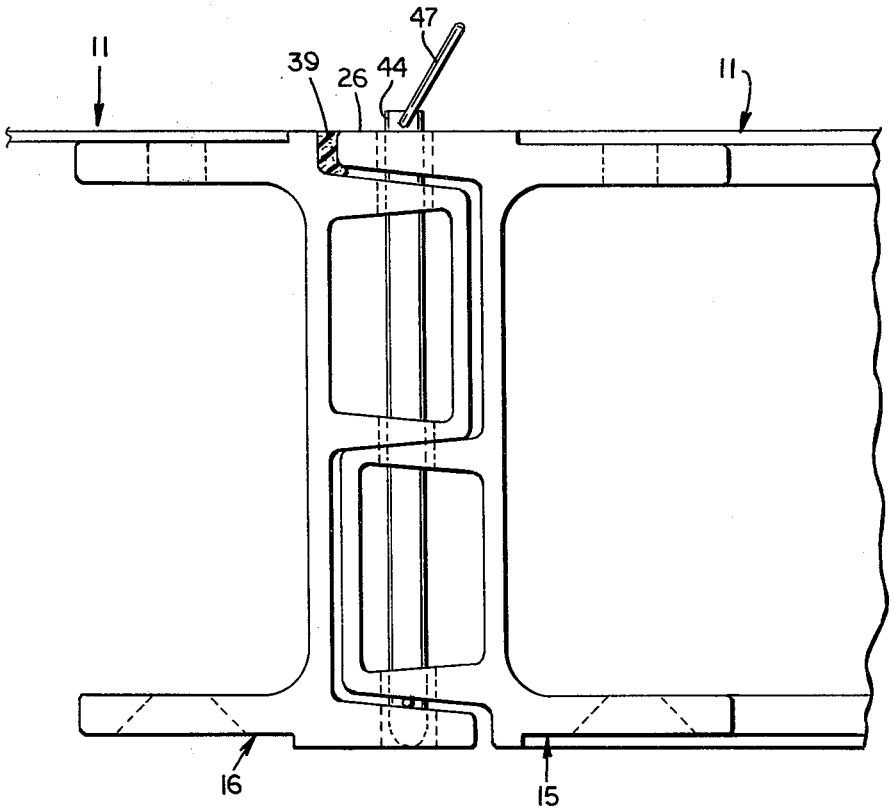
FIG. 3 is an end view of abutting side beams of the frame of the floor module of FIG. 2.

External groove 38 is formed above box formation 25 behind ridge 36, and compressible gasket 39 is adhesively attached in groove 38. Lock pin openings 40, 41 and 42 are formed at intervals along the lengths of side beams 15 and 16 and of end beams 18 and 19 and extend through the upper and lower walls of box formation 25 and lower through flange 26 in alignment with one another for receiving lock pins 44 that connect the beams toether in their nested relationship (FIG. 3). Rectilinear lock pins 44 are telescopically inserted downwardly through the lock pin openings 40, 41 and 42 of the nested tongue and groove structures of abutting beams. Additionally, aligned connector openings 45 and 46 are formed in the internally extending lower and upper parallel flanges 21 and 22, respectively, of the beams 15, 16, 18 and 19. Eye bolts 12 or rivets 71 are insertable through the aligned connector openings 45 and 46.

As illustrated in the left portion of FIG. 2, side beam 16 is reversed with respect to side beam 15 on the right side of the figure, in that the tongue and groove structure of each beam is projected outwardly to the left of the frame, and side beam 16 is inverted with respect to side beam 15, in that the box formation 25 is positioned below flange 26. In a similar manner, the end beams 18 and 19 are reversed and inverted with respect to each other. Thus, a C-shaped space or channel is formed about the entire internal periphery of the frame of beams 15, 16, 18 and 19 and the tongue and groove structure is projected outwardly about the external periphery of the floor module and the tongue and groove structure is inverted from side-to-side and from end-to-end of the floor module.

Figure 4:
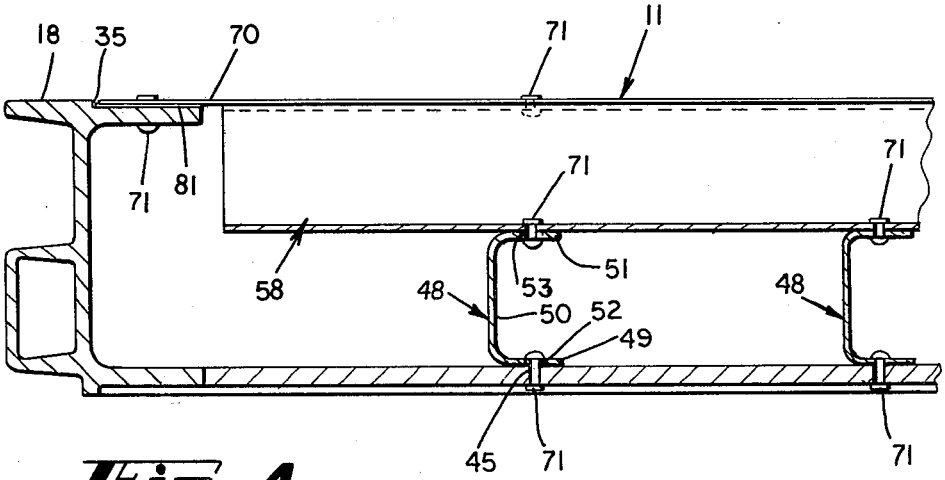
FIG. 4 is a partial side cross-sectional view of a floor module.

As illustrated in FIGS. 2 and 4, a plurality of rectilinear cross braces are located inside the frame formed from beams 15, 16, 18 and 19, with each cross brace connected at its ends to the side beams 15 and 16. The cross braces 48 illustrated herein are "C" shaped and include lower flange 49, web 50 and upper flange 51. Lower flange 49 of each cross brace 48 rests upon the lower, internally extending flange 21 or 22 of the side beams 15 and 16. Aligned openings 52 and 53 are formed in lower and upper flanges 49 and 51, respectively, at their ends and the screw 54 of an eye bolt 12 or rivets 71 are inserted therethrough and through the aligned connector openings 45 and 46 of the internally projecting flanges 21 and 22 of the side and end beams 15 and 16. In order to positively lock the cross braces 48 in abutment with the lower internally extending flanges 21 and 22 of the side beams with an eye bolt 12, the eye bolts and cross braces are spot-welded at 55 and 56. In the alternative, lock nuts and washers (not shown) can be threaded onto each screw 54 until the screws draw the cross braces against the lower internally projecting flanges 21 and 22. Also, a spot weld between the upper flanges 51 or the cross braces 48 and the screw 54 can be substituted for the lock nut and washer.

A corrugated sheet or V-beam 58 is positioned over the series of cross braces 48. Corrugated sheet 58 includes side edge portions 59 and 60 which overlap the outer, upper surfaces of the upper internally projecting flanges 22 and 21 of side beams 15 and 16, and a plurality of parallel folds are formed in the sheet. The folds 61, 62, 63 and 64 are repeated across the sheet from one side edge portion to the other and form downwardly and upwardly sloped panels 65 and 66 and lower and upper horizontal panels 68 and 69. Lower and upper panels 68 and 69 are riveted respectively to cross braces 48 and flat sheet 70 by conventional rivets 71. Flat sheet 70 and corrugated sheet 58 are also connected at their edge portions 72 and 73 by means of hanger pins or eye bolts 12 and rivets 71 to the upper internally projecting flange 21 and 22 of the side beams 15 and 16.

Eye bolts 12 further include an upper lock nut 75 and washer 76 threaded on its screw 54 into abutment with the under surface of the upper inwardly projecting flange 21 or 22 of each side beam 15 and 16, and eye fitting 78, washer 79 and lock nut 80 are threaded on the upwardly protruding end of screw 54. In those instances where an eye bolt 12 is not needed, rivets 71 can be utilized to rigidly connect the flat sheet 70 and corrugated sheet 58 to the upper internally projecting flanges 21 and 22 of the beams and similar rivets can be used to connect the cross braces 48 to the lower internally connecting flanges 21 and 22 of the side beams. When the floor panel is suspended by its eye bolts 12, upper lock nut 75 of each eye bolt bears against the lower surface of its upper flange 21 or 22 while the head of the screw 54 bears against the lower surface of its lower flange 22 or 21 so that the lifting force is applied to both the lower and upper flanges of the beams 15, 16, 18 and 19.

As illustrated in FIG. 4, the corrugated sheet 58 is of a length shorter than the distance between end beams 18 and 19, but the flat sheet 70 extends beyond corrugated sheet 58 and overlaps the stepped down portion of the upper surfaces of the end beams 18 and 19. A spacer 81 is placed between flat sheet 70 and the upper surface of end beams 18 and 19 so that the top exterior surface of flat sheet 70 is substantially co-extensive with the top exterior surface of the ridges 35 and 36. Thus, a substantially smooth upper surface is formed on the floor module 11.

As illustrated in FIG. 3, when the floor modules 11 are positioned so that their tongue and groove peripheral edges interfit with one another, the gasket 39 in the recess 38 will be compressed by the outer abutting edge of the upper outwardly projecting flange 26, and the openings 40, 41 and 42 of each beam will become aligned so that the connector or lock pin 44 can be telescopically inserted through the tongue and groove structure and lock the floor modules together. Optionally, an adhesive tape (not shown) will be placed over the abutting edge structures, including the finger ring 47 of the lock pins 44 so as to additionally seal the cracks between the abutting floor panels. It will be noted that the tapered box formation 25 and the tapered surfaces 32 of the outwardly projecting flange 26 permit a snug nesting of the tongue and groove formations of the abutting beams. Thus, a strong, tight and durable connection is made between the beams and the floor modules are substantially sealed when connected together, even when the strips of sealing tape have not been applied.

In order to further avoid spillage of sand and debris from the suspended modular floor assembly and to form a vapor barrier, sheets of impervious material, such as flexible polyethelene vinyl or mylar can be spread about the floor assembly.

While this invention has been described in detail with particular reference to a preferred embodiment thereof, it will be understood that variations and modifications can be effected within the spirit and scope of the invention as described hereinbefore and as defined in the appended claims.

We claim:

1. A suspended modular floor assembly for suspension from the truss structure of a roof of an industrial building, said floor assembly comprising a plurality of modules of similar size and shape and in abutment with one another at their edges, each said module comprising parallel side beams and parallel end beams each joined at their ends to one another and forming a peripheral rectangular frame, said side and end beams each constructed of similar cross-sectional shape with an upright web extending from top to bottom of and along the length of the beam, spaced upper and lower parallel flange members extending from one side of said web inwardly of the frame, the upper surface of said upper flange and the lower surface of said lower flange each being formed with a ridge with a recessed step surface extending to the side edge of each of said upper and lower flanges, and a tongue and groove formed on the other side of said web and extending outwardly of the frame with the tongue positioned over the groove for one side beam and one end beam and with the groove positioned over the tongue for the other side beam and the other end beam, said tongue comprising a closed box formation with said web and including an upper wall and a lower wall each connected at one edge to said web and an outer wall connected at its edges to said upper and lower walls, a plurality of elongated cross braces extending parallel to one another and connected at their ends to the lower flange members of the side beams, a corrugated support sheet positioned over said cross braces with the folds of its corrugations extending across the lengths of and engaging said cross braces, said corrugated support sheet being joined at its opposite edges to and overlying the recessed step surfaces of the upper flange of said side beams, a flat sheet member positioned over said corrugated support sheet and joined at its edges to and overlying the recessed step surfaces of the upper flange of said side beams, and hanger bolts extending through said upper and lower flange members of the beams of said rectangular frame, said bolts including connection means positioned over the beams for connection to a suspension line or the like.

2. The suspended modular floor assembly of claim 1 and further including connector pin openings formed through the tongues and grooves of said side and end beams, whereby the tongues and grooves of the modules interfit with the tongues and grooves of adjacent modules and connector pins are inserted through the connector pin openings of interfitting tongues and grooves to connect the modules together.

3. The suspended modular floor assembly of claim 1 and wherein said corrugated support sheet is connected at alternate ones of its folds to said cross braces and at the other alternate ones of its folds to said flat sheet member.

4. The suspended modular floor assembly of claim 1 and further including a seal strip positioned between the tongue and groove structure of abutting modules for sealing the abutting modules together.

5. A module for a suspended floor comprising parallel side beams and parallel end beams joined together at their ends to one another and forming a rectangular frame, said beams including a tongue and groove outer peripheral edge, a sheet member connected at its edges to one surface of said rectangular frame, and support means mounted internally of said rectangular frame for supporting said sheet member across the space defined by said rectangular frame, said side beams and end beams of said frame each including an upright web, said tongue and groove outer peripheral edge joined to one side of said web, and upper and lower parallel flanges extending from said web inwardly into the space defined by said frame, the upper surface of the upper flanges and the lower surface of the lower flanges of the side beams and end beams each being formed with a ridge with a recessed step surface extending to the side edge of each of said upper and lower flanges, said support means comprising elongated cross braces extending parallel to one another and supported at their ends by said side beams between said upper and lower flanges and a corrugated support sheet mounted on said cross braces with the folds of said corrugated support sheet extending normal to the lengths of said cross braces, said sheet member mounted to said corrugated support sheet, said corrugated support sheet and said sheet member being joined at their edges to and overlying the recessed step surface of said side beams, and said side beams and said end beams each defining lock pin openings extending through the tongue and groove outer peripheral edge, whereby the peripheral edge of one module can be placed in interfitting abutment with the peripheral edge of a similar module and lock pins inserted through aligned lock pin openings to connect the modules together.

6. The module of claim 5 and further including eye bolts extending through said side beams and including an eye opening positioned over the side beams for suspending the module from a higher support structure.

* * * * *

UNITED STATES PATENT AND TRADEMARK OFFICE

CERTIFICATE OF CORRECTION

PATENT NO. : 4,404,782

DATED : September 20, 1983

INVENTOR(S) : Virgil R. Williams et al.

It is certified that error appears in the above-identified patent and that said Letters Patent is hereby corrected as shown below:

The title page showing the illustrative figure should be deleted to appear as per attached page.

Signed and Sealed this

*Seventeenth* Day of *July 1984*

[SEAL]

*Attest:*

GERALD J. MOSSINGHOFF

*Attesting Officer*

*Commissioner of Patents and Trademarks*

United States Patent [19]
Williams et al.
[11] 4,404,782
[45] Sep. 20, 1983

[54] SUSPENDED MODULAR FLOOR ASSEMBLY

[76] Inventors: Virgil R. Williams, 2055 Webb Jin House Rd., Snellville, Ga. 30278; James M. Williams, Jr., 2980 Payton Rd., NE., Atlanta, Ga. 30345

[21] Appl. No.: 180,137
[22] Filed: Aug. 21, 1980
[51] Int. Cl.³ ..... E04B 5/52; E04B 5/58
[52] U.S. Cl. ..... 52/475; 52/484; 52/585; 52/592; 52/799
[58] Field of Search ..... 52/DIG. 12, 484, 236.3, 52/126, 580, 585, 582, 589, 592, 799, 801, 822, 827, 403, 485, 729, 793, 309.11, 745, 475

[56] References Cited

U.S. PATENT DOCUMENTS

| | | | |
|---|---|---|---|
| 1,867,433 | 7/1932 | Young | 52/483 |
| 2,103,969 | 12/1937 | Davis et al. | 52/485 |
| 2,715,013 | 8/1955 | Slick | 52/126 |
| 2,923,305 | 2/1960 | Cline | 52/585 |
| 4,090,339 | 5/1978 | Anderson | 52/580 |

FOREIGN PATENT DOCUMENTS

| | | | |
|---|---|---|---|
| 667593 | 7/1963 | Canada | 52/403 |

*Primary Examiner*—John E. Murtagh
*Assistant Examiner*—Michael Safavi

[57] ABSTRACT

The suspended modular floor assembly includes a plurality of modules of similar size and shape positioned in abutment with one another at their edges and suspended from an overhead ceiling support truss of an industrial building. Each module includes parallel side beams and parallel end beams joined at their ends to form a rectangular frame, with the beams each including external tongue and groove surfaces to mate with the tongue and groove surfaces of the adjacent modules. A plurality of elongated cross braces extend parallel to one another across the rectangular frame, a corrugated support sheet is mounted on the cross braces, and a flat sheet is supported by the corrugated support sheet. Connector pins fit through and join the tongue and groove edge portions of abutting modules, a gasket seals the modules at their abutting edges and eye bolts extend through the beams of the rectangular frames of the modules and are connectable to suspension cables that support the modules of the floor assembly from the overhead truss of the building.

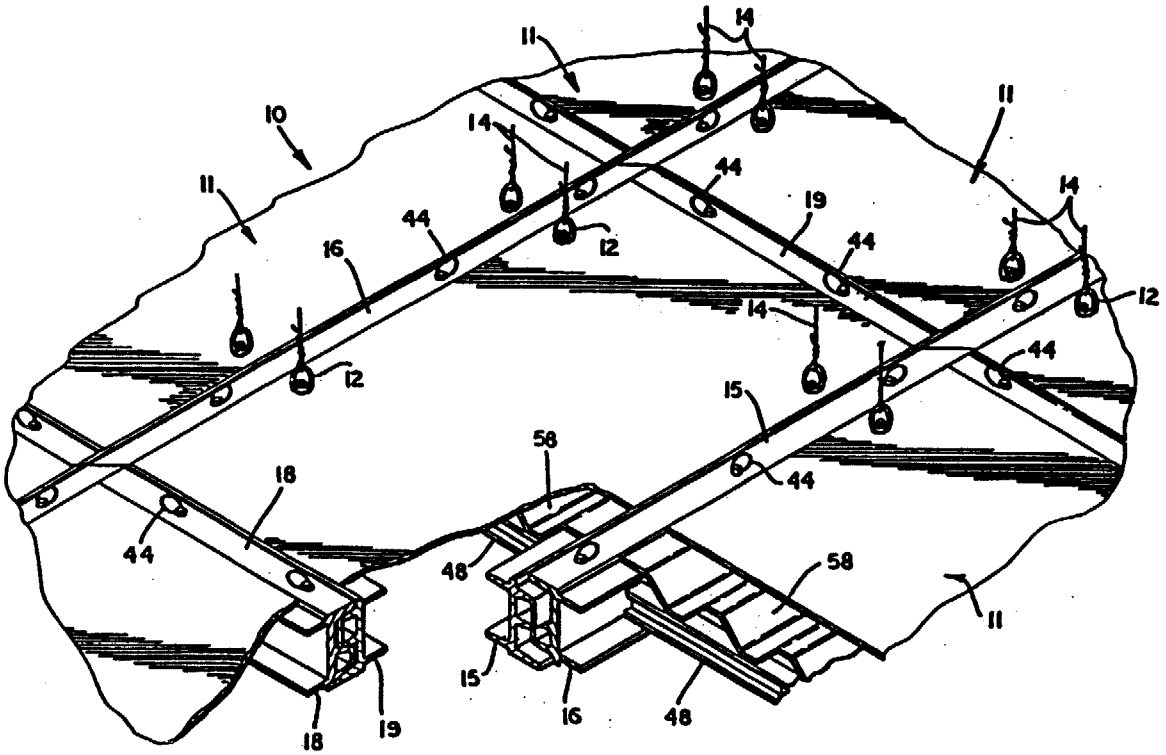

6 Claims, 4 Drawing Figures